US006439626B1

(12) United States Patent
Rohlfing

(10) Patent No.: US 6,439,626 B1
(45) Date of Patent: Aug. 27, 2002

(54) ACTUATING DEVICE FOR A DOOR LOCK WITH A HINGED HANDLE, ESPECIALLY FOR A VEHICLE LOCK

(75) Inventor: Manfred Rohlfing, Essen (DE)

(73) Assignee: Huf Hülsbeck & Fürst GmbH & Co., KG, Velbert (DE)

( * ) Notice: Subject to any disclaimer, the term of this patent is extended or adjusted under 35 U.S.C. 154(b) by 0 days.

(21) Appl. No.: 09/646,856

(22) PCT Filed: Mar. 1, 1999

(86) PCT No.: PCT/EP99/01326

§ 371 (c)(1),
(2), (4) Date: Sep. 22, 2000

(87) PCT Pub. No.: WO99/49162

PCT Pub. Date: Sep. 30, 1999

(30) Foreign Application Priority Data

Mar. 26, 1998 (DE) ..... 198 13 316

(51) Int. Cl.[7] ..... E05B 1/00

(52) U.S. Cl. ..... 292/347; 292/336.3; 292/348; 16/412; 16/413; 16/414; 16/110.1; 16/DIG. 24; 411/549; 411/553

(58) Field of Search ..... 292/347, 348, 292/336.3; 16/412, 413, 414, 110.1, DIG. 24; 411/549, 553

(56) References Cited

U.S. PATENT DOCUMENTS

| | | | | | |
|---|---|---|---|---|---|
| 2,123,866 | A | * | 7/1938 | Anderson | 292/336.3 |
| 2,355,978 | A | * | 8/1944 | Keeler | 16/412 |
| 2,567,565 | A | * | 9/1951 | Keeler et al. | 292/347 |
| 3,020,076 | A | * | 2/1962 | Biondo | 292/336.3 |
| 3,426,385 | A | * | 2/1969 | Gutshall | 16/412 |
| 4,232,892 | A | | 11/1980 | Kuki | |
| 4,883,296 | A | * | 11/1989 | Laurie | 292/336.3 |
| 5,377,450 | A | * | 1/1995 | Varajon | 49/502 |
| 5,421,061 | A | * | 6/1995 | Kölle et al. | 16/114 R |
| 5,632,061 | A | * | 5/1997 | Smith et al. | 16/110 R |
| 5,662,375 | A | * | 9/1997 | Adams et al. | 296/214 |
| 5,725,262 | A | * | 3/1998 | Kritzler | 292/336.3 |
| 5,860,684 | A | * | 1/1999 | Mizuki | 292/336.3 |
| 5,887,918 | A | * | 3/1999 | Okada et al. | 292/336.3 |
| 5,975,597 | A | * | 11/1999 | Makiuchi et al. | 292/336.3 |
| 6,067,869 | A | * | 5/2000 | Chilla et al. | 74/96 |
| 6,267,543 | B1 | * | 7/2001 | David et al. | 411/552 |

FOREIGN PATENT DOCUMENTS

| | | |
|---|---|---|
| DE | 195 08 518 A1 | 9/1996 |
| FR | 9514905 | 1/1998 |

* cited by examiner

*Primary Examiner*—Kathy Matecki
*Assistant Examiner*—Carlos Lugo
(74) *Attorney, Agent, or Firm*—Friedrich Kueffner

(57) ABSTRACT

An actuator for a vehicle door lock has an exterior handle with a flap and an inner support on which the flap is pivotally supported. The flap has stays with connecting points penetrating an opening in the vehicle door. A first connecting point has a pivot pin and a pivot seat. When inserting the pivot pin into the pivot seat, the handle is in an angular position relative to its final fastening position. The pivot seat has an inner shoulder engaged by a radial projection of the pivot pin for axially securing the pivot pin. The second connecting point has a first part on the handle and a second part on the flap. The handle is rotated back from the angular position until the first and second parts of the second connecting point are radially aligned. They are then connected to one another and the final fastening position of the handle is determined.

24 Claims, 6 Drawing Sheets

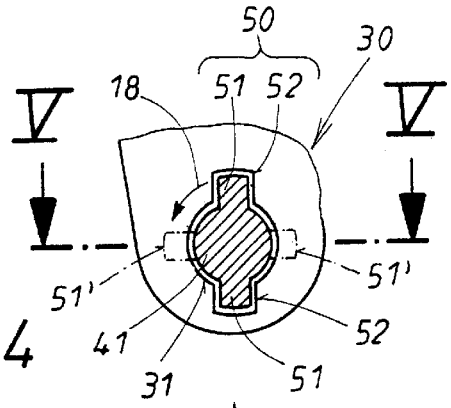
FIG. 4
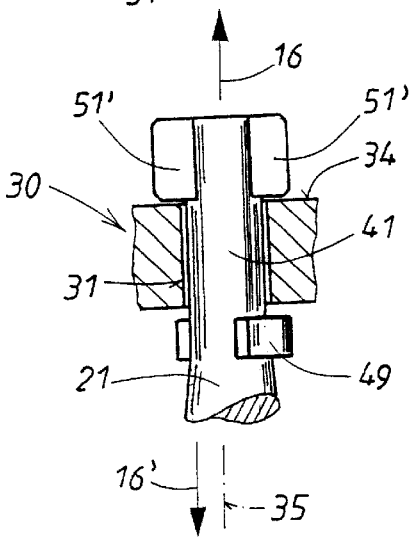
FIG. 5
FIG. 6
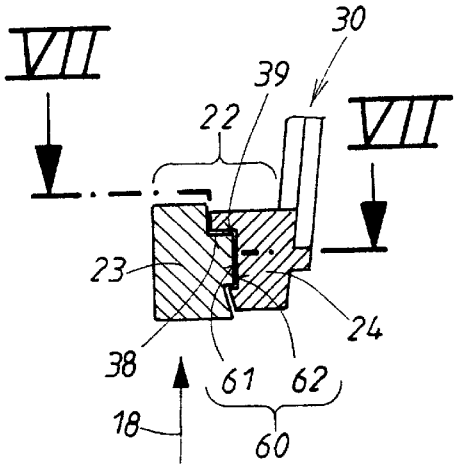
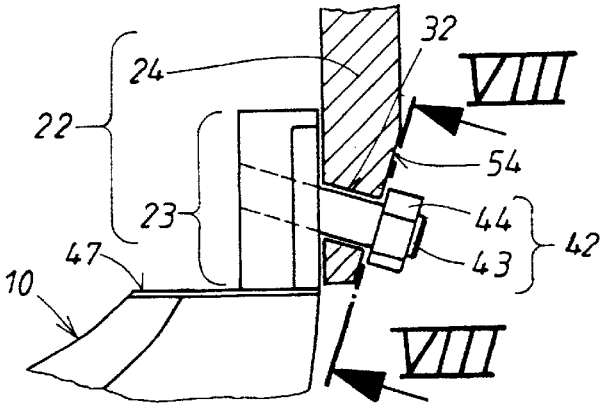
FIG. 7
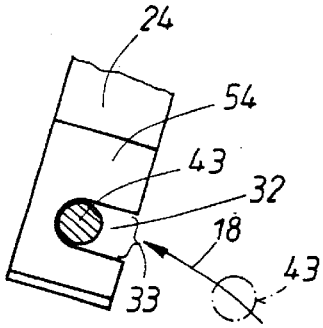
FIG. 8

ACTUATING DEVICE FOR A DOOR LOCK WITH A HINGED HANDLE, ESPECIALLY FOR A VEHICLE LOCK

BACKGROUND OF THE INVENTION

1. Field of the Invention

In the past, the mounting of an actuating device with a hinged handle in the door was cumbersome and unsatisfactory. Such devices are comprised of at least three components, i.e., a support arranged at the inner side of the door with a bearing axis which extends substantially parallel to the door plane, a hinged flap connected thereto, and a handle which is arranged on the outer side of the door. After having been fastened, the handle and the flap form a single component so as to pivot together.

2. Description of the Relevant Art

In a first known actuating device the handle and the flap were formed together as a monolithic part and a portion of the outer sheet metal of the door, having a recessed depression, was integrated with the support. Between the upper longitudinal edge of the handle and the flap an angled strip was located which penetrated a corresponding slot in the outer sheet metal of the door. This resulted in sealing problems relative to the adjoining areas of the outer sheet metal of the door. Moreover, the portion seated on the support had to be matched individually to the respective color of the outer sheet metal of the door which was cumbersome and incurred high storage costs for the entire color palette.

More favorable with respect to sealing is an actuation device of the kind having a hinged handle arranged on the outer side of the door, having a support connectable at the inner side of the door behind an outer sheet metal of the door, which comprises a substantially parallel extending bearing axle relative to the door plane for a flap to be supported thereat in a pivotal way, wherein the flap has two connecting points for the two ends of the handle positioned at the outer side of the door before the outer sheet metal of the door and the flap with the handle connected thereto form a single component so as to pivot together, which, in the area of the two handle connecting points has stays which penetrate an opening in the outer sheet metal of the door. In this known actuating device, the handle with its two handle ends is connected to two stays which are fixed components of the support arranged on the inner side of the door. In this case only two penetrations in the door covering are required through which the stays are guided when mounting the device. The stay ends serve to fasten the handle wherein the two fastening locations are located on the outer side of the door not only in the folded-out position but also in the folded-in position of the handle; they are therefore visible in a distracting way and may provide a reason for manipulations by unauthorized persons. In the known device the fastening means were two threaded screws which each connect a flap pair between the stay on the flap, on the one hand, and the end of the handle, on the other hand. Moreover, the fastening of the handle on the flap was time-consuming and cumbersome.

SUMMARY OF THE INVENTION

The invention has the object to develop a reliable device of the aforementioned kind which can be mounted and demounted quickly and easily. This is achieved according to the invention in that the first connecting point provided on the first stay is comprised a rotary bearing comprised of a pivot pin and a pivot seat, whose pivot axis extends substantially perpendicularly to the door plane and thus determines an insertion direction of the pivot pin into the pivot seat oriented in the same direction, wherein during insertion of the pivot pin into the pivot seat the handle is rotated about an angle relative to its final fastening position on the flap; in that on the free end of the pivot pin at least one radial projection is provided having correlated therewith an opening at the pivot seat and the opening allows passage of the projection during insertion of the pivot pin, in that the pivot seat, viewed in the insertion direction, has behind the opening an inner shoulder extending transversely thereto, which is engaged from behind by the projection of the inserted pivot pin and then makes the rotary bearing between the handle and the flap axially non-detachable; in that the second connecting point provided on the second stay is comprised of two parts of which one part belongs to the handle and the other part belongs to the flap, and the handle is rotatable on the outer side of the door in the rotary bearing of its first connecting point to such an extent that the two parts of the second connecting point will become radially aligned with one another, and in that then the two aligned parts of the second connecting point are connected to one another and determine the final fastening position of the handle on the flap.

According to the invention, the first connecting point between the handle and the flap is provided on the first stay and is formed by a pivot pin and a pivot seat which can be coupled to one another by insertion. In the coupled situation they determine a rotational axis which extends perpendicularly to the plane of the door. This results in an especially simple mounting of the handle.

First the flap is supported in a pivotable way on the bearing axle provided on the support and this component is mounted on the inner side of the door. Subsequently, the flap is transferred into the folded-out position in which the connecting points provided on the flap are aligned with the two openings in the outer sheet metal of the door. Through one of the openings the aforementioned coupling between the pivot pin and the pivot seat on the first stay is realized. Subsequently, the handle on the outer side of the door must only be rotated about an angle until the two stay parts provided at the second connecting point are radially aligned with their fastening points. The two aligned fastening points must then only be connected to one another by suitable fastening means in order to secure the handle in the final fastening position on the flap. The fastening means on the second stay can be easily actuated in the folded-out position of the support from the outer side of the door. In the folded-in position of the component comprised of the handle and the flap they are invisible.

BRIEF DESCRIPTION OF THE DRAWINGS

Further measures and advantages of the invention result from the dependent claims, the following description, and the drawings. In the drawings the invention is illustrated in several embodiments. It is shown in:

FIG. 4 a cross-sectional plan view of the first connecting point between the combination and the flap along the section line IV—IV indicated in FIG. 3, during a first movement phase of a two-step adjustment movement;

FIG. 5 also on an enlarged scale a longitudinal section of this first connecting point along the section line V—V of FIG. 4 after the two closure halves of the adjusting connection have completed the last movement phase;

FIG. 6 on an enlarges scale a cross-section of the two portions of the second stay on the oppositely located handle end along the section line VI—VI of FIG. 3 when the two stay portions illustrated therein have been brought in contact with one another;

FIG. 7 on an enlarged scale the second fastening point between handle and flap, partially in section, along the staggered section line VII—VII of FIG. 1;

FIG. 8 a sectional side view of FIG. 7 in the viewing direction of VIII—VIII of FIG. 7;

DESCRIPTION OF THE PREFERRED EMBODIMENTS

Figure 9:
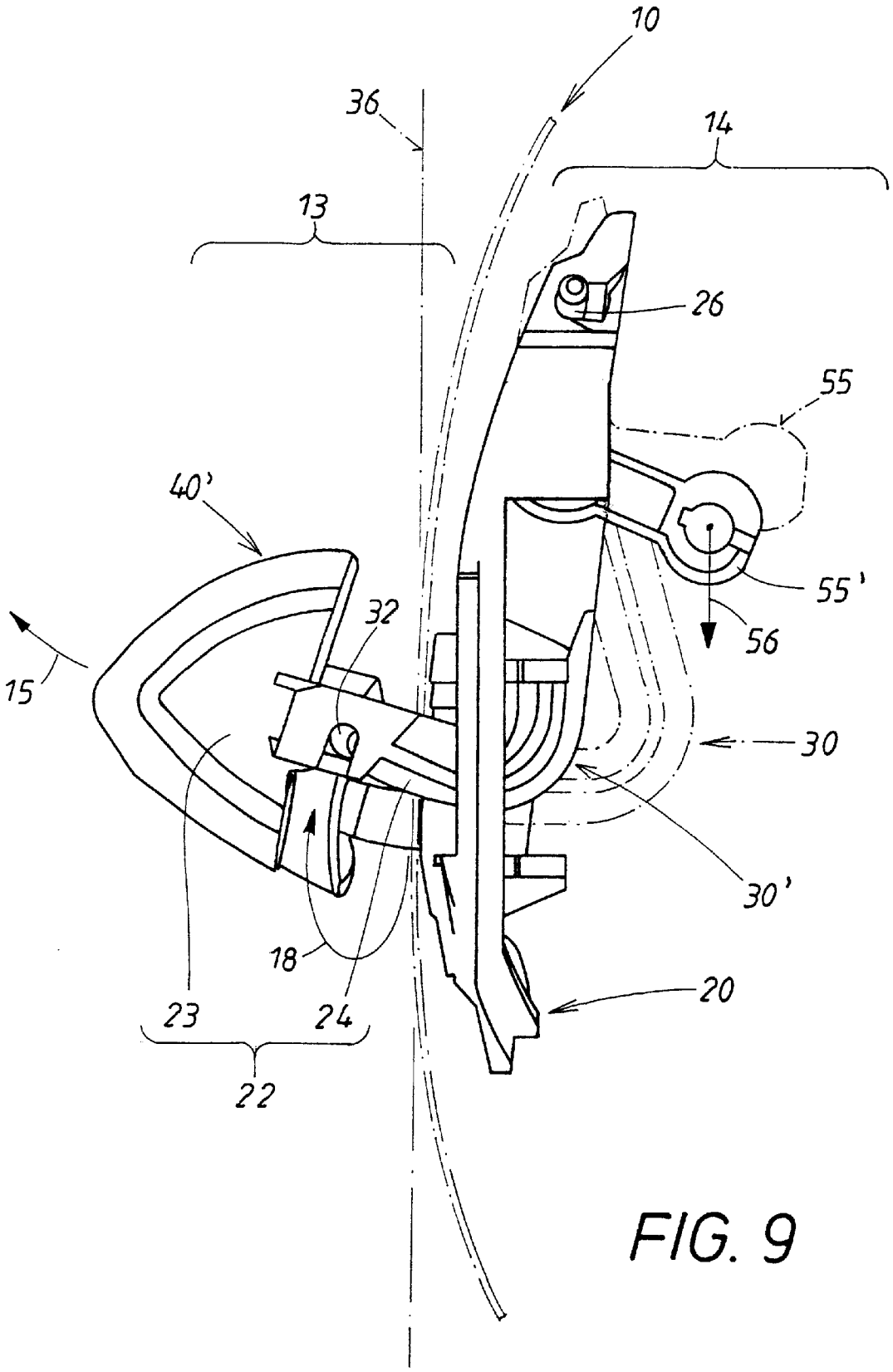
FIG. 9 a side view of a completely mounted device, wherein the outer sheet metal of the door is indicated in a dash-dotted line and the component comprised of the handle and the flap is shown in two folded positions, i.e., in the fully folded-out position and the fully folded-in position.

The actuating device can be divided in principle into three components 20, 30, 40 which, as can be seen in FIG. 9, are entirely or partially arranged on opposite sides of the door illustrated by the outer sheet metal 10 of the door. Firstly, there is a hinged handle 40 arranged on the outer side 13 of the door; the handle 40 is illustrated in FIG. 9 in solid lines in the folded-out position 40'. The handle 40 is subjected to a restoring force which has a tendency to transfer it into the folded-in position. The folded-in position of the handle 40 is not illustrated in FIG. 9.

Figure 1:
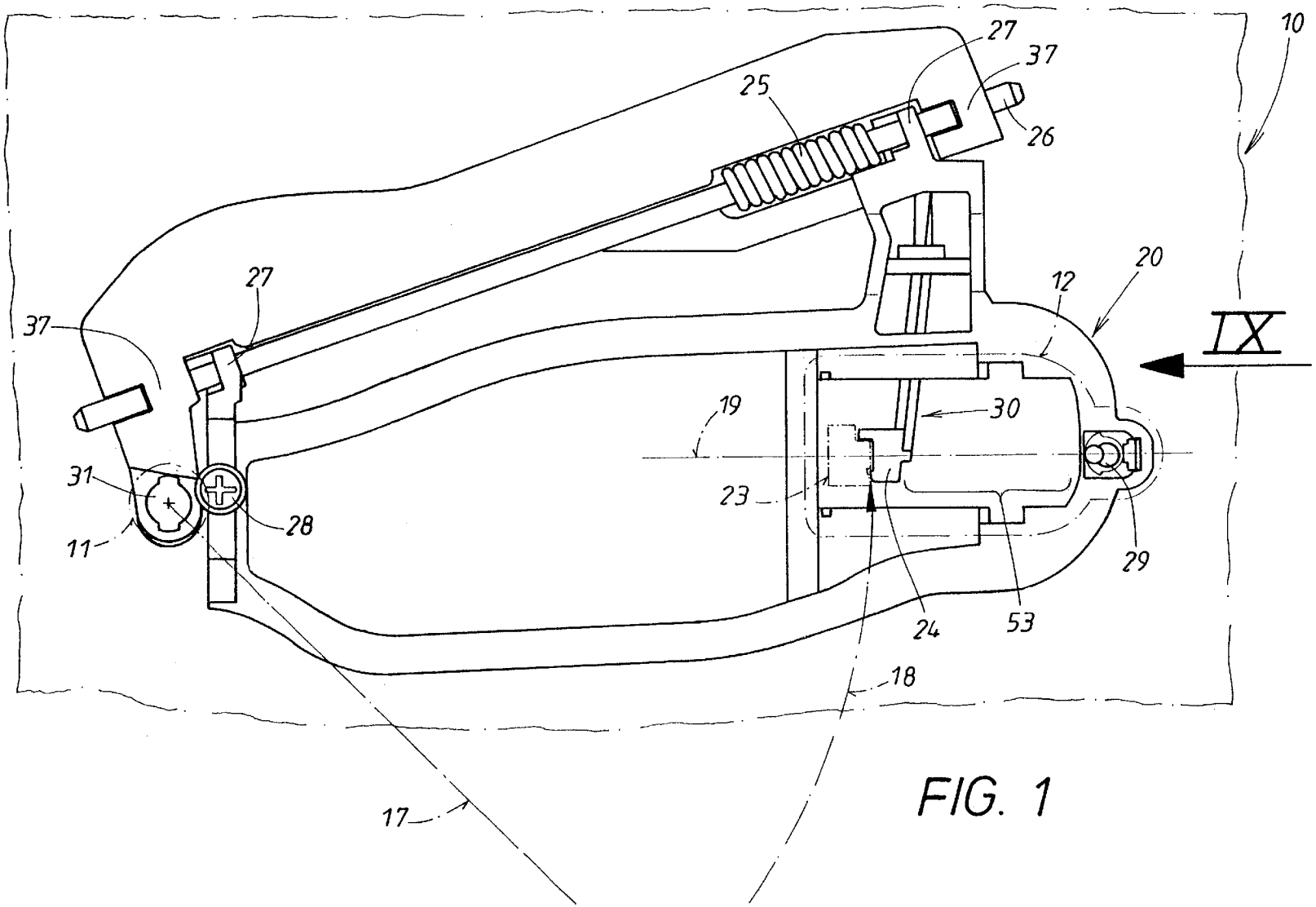
FIG. 1 the plan view onto the support of the device according to the invention with the flap supported thereat in a hinged way before a special handle/stay combination is fastened on the flap.
Figure 3:
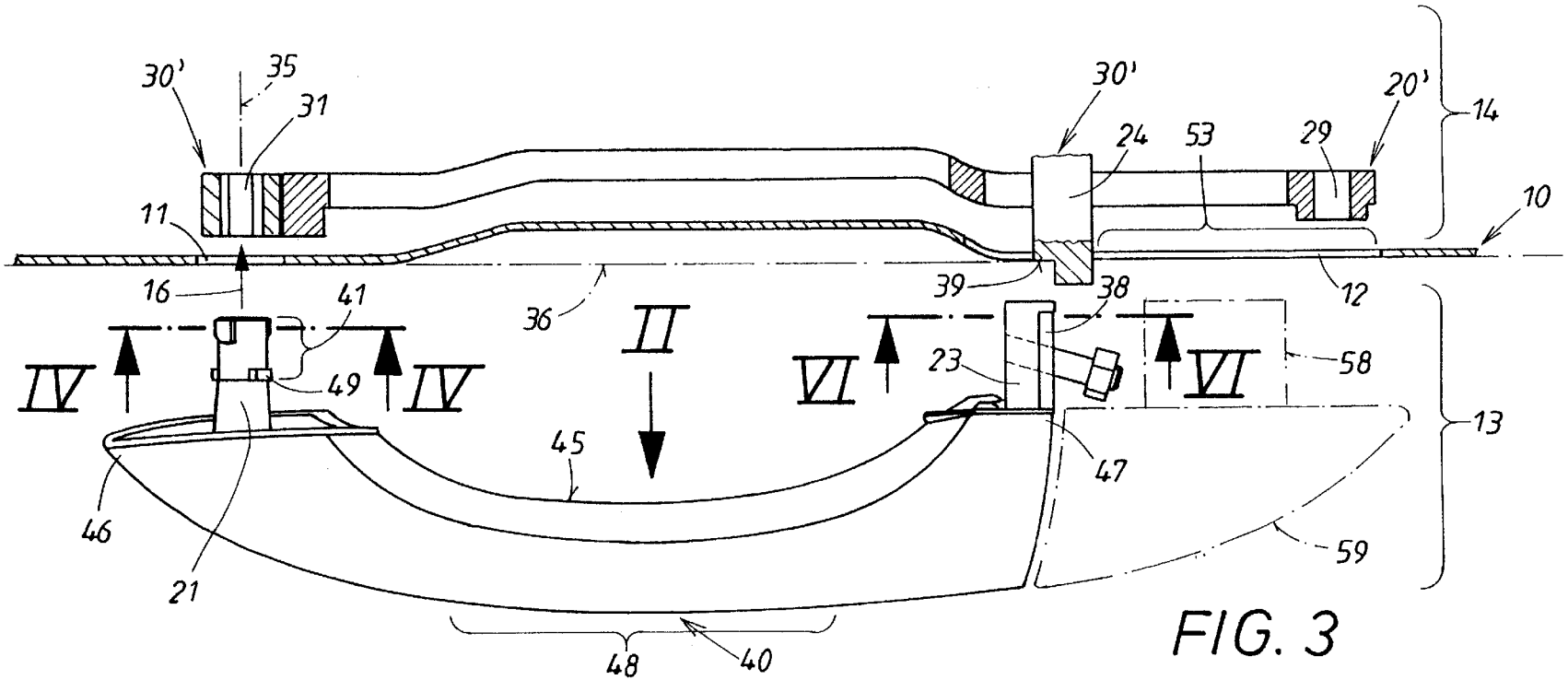
FIG. 3 portions of the flap, partially in horizontal section, supported in a hinged way on the support on an outer sheet metal of the door and the plan view onto the combination, already shown in FIG. 2, before its attachment on the support.

At the inner side 14 of the door, behind the outer sheet metal 10 of the door, a support 20 is mounted which for this purpose has suitable fastening locations 28, 29 shown in FIG. 1 and in FIG. 3, showing fastening location 29 at the end 20'. The support 20 comprises primarily bearing locations 27 for a bearing axle 26 which extends substantially parallel to the door plane, i.e., approximately in the direction of extension of the outer sheet metal 10 of the door. The bearing axle 26 can be arranged at a slant to the horizontal and serves to support a flap 30 with a pivotal supporting action for which purpose this flap has corresponding counter bearing locations 37 as can be seen in FIG. 1. On the bearing axle 26 a torsion spring 25 is seated which acts between the support 20 and the flap 30 and provides the aforementioned restoring force for the handle 40 to be fastened on the flap 30. In FIG. 9 the folded-out position of the flap is illustrated at 30' in solid lines while the folded-in position 30 is illustrated with dash-dotted lines. After fastening of the handle 40, the handle 40 and the flap 30 form a single component so as to pivot together.

Figure 2:
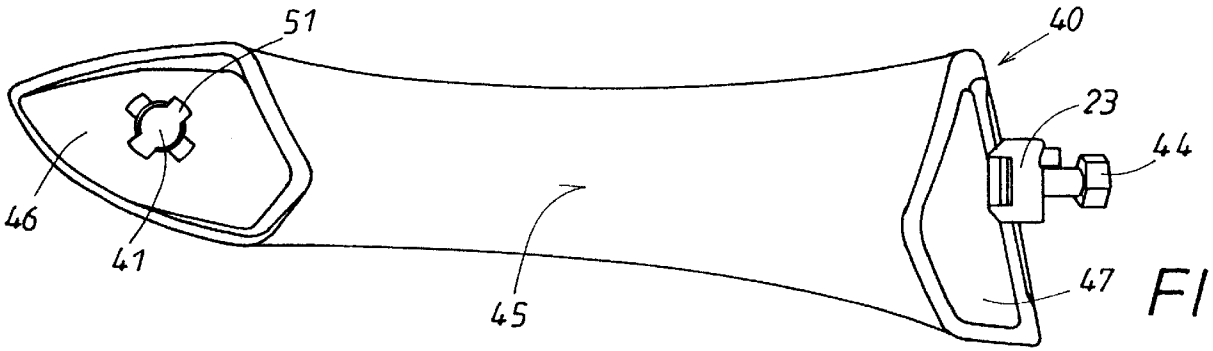
FIG. 2 the inside view of the combination to be fastened on the component of FIG. 1.

As can be seen in FIGS. 2 and 3, the handle 40 according to the invention is arc-shaped and has a concave arc side 45 facing the door sheet metal 10. The handle 40 is fastened in the area of its two arc ends 46, 47 to the flap 30 in a special way which will be explained in the following in more detail. After fastening, the concave arc side 45 provides an opening for a human hand relative to the door sheet metal 10. For the folding-out movement 15 illustrated in FIG. 9, the handle 40 can be completely gripped all around by a human hand within its central arc portion 48, illustrated in FIG. 3, like a pull handle. For fastening the handle 40, connecting points 31, 41; 32, 42 at the two handle ends 46, 47 are provided which are positioned in the area of the two stays 21, 22. These two stays 21, 22 penetrate two separate openings 11, 12 provided in the outer sheet metal 10 of the door. These two connecting points 31, 34; 32, 42 are very differently designed and are used not simultaneously, but sequentially, during mounting of the handle 40 on the support.

As can be seen in FIG. 3, the first stay 21 provided on one handle end 46 is a monolithic component of the handle 40 and forms therewith a handle/stay combination 40, 21. This combination includes also a first portion 23 of the second stay 22 shown in FIG. 7 on the oppositely positioned handle end 47. A fixed component of the flap 30 is the second portion 24 of this second stay 22. This second stay portion 24 forms together with the flap 30, as can be seen in FIG. 1, a monolithic asymmetric flap component 24, 30.

On the free end of the first stay 21 provided on the handle 40, as can be seen in FIG. 3, a pivot pin 41 is provided which is a part of the first connecting point. The other part of this connecting point is the pivot seat 31 provided within the support. For mounting the handle, the flap 30 is transferred into its folded-out position which can be present in FIG. 3. Subsequently, the handle 40 is guided, from the outer side 13 of the door, with its pivot pin 41 through the aforementioned first opening 11 in the outer sheet metal 10 of the door and is inserted into the pivot seat 31 of the flap 30 in the direction of arrow 16 illustrated in FIGS. 3 and 5. This insertion movement 16 requires the handle 40 to be in a certain angular position 17 which is illustrated in FIG. 1 by a dash-dotted line. This is so because the pivot seat 31 and pivot pin 41 are also formed as the two closing halves 51, 52, which are complementary to one another, of an adjusting connection 50 whose configuration and function can be taken from FIGS. 4 and 5.

In the present case, one of the closing halves of the adjusting connection 50 is comprised of two radial projections 51 which are seated diametrically to one another on the pivot pin 41. The other closing half of the adjusting connection 50 is formed complementary to the contour of the radial projections 51 as a radially widened portion 52 of the pivot seat 31. Only when the handle 40 with the stay 21 formed thereon is positioned in the afore described angular position 17 illustrated in FIG. 1 are the two closing halves 51, 52 of the adjusting connection 50 in axial and radial alignment and allow the aforementioned insertion movement 16 of the pivot pin 41 into the pivot seat 31. The magnitude of the insertion movement 16 can be limited by a collar 49 or collar segments on the stay 21. In the stop position of the collar 49 the radial projections 51, when viewed axially, are positioned behind the inner shoulder 34 of the flap 30. The insertion movement 16 is the first movement phase of a two-stay adjusting movement. After the insertion movement 16 a rotational phase 18 of the adjusting movement is carried out which is illustrated in FIG. 4 as well as in FIG. 1. This has two consequences.

Upon rotation 18 of the handle, as can bee seen best in FIGS. 4 and 5, the radial projection 51 glides with its axial edge behind the inner shoulder 34 and thus locks the coupling position of the pivot pin 41 in its pivot seat 31. When performing this rotational movement, a first connecting point 31, 32 produces a rotational axis 35 for the second movement phase 18 of the handle 40. This rotational axis 35 extends substantially perpendicularly to the door plane 36 which is also illustrated in FIG. 3 as a dash-dotted line. This door plane 36 is determined by the extension direction of the outer sheet metal 10 of the door. At the end of the rotational movement 18 the door handle is positioned in a substantially horizontal final fastening position which is illustrated in FIG. 1 by the horizontal dash-dotted line 19. In the locked position 51', illustrated in a dash-dotted line in FIG. 4 and in a solid line in FIG. 5, a pulling-out movement 16' of the pivot pin 41 from the pivot seat 31 counter to the insertion movement 16 is prevented according to FIG. 5. The two closing halves 51, 52 on the pivot seat 31 and the pivot pin 41 of the first connecting point between the flap 30 and the handle 40 thus produce at the same time the fastening means which ensure a connection of the two components 30, 40 at this location.

The rotational movement 18 also has a further consequence in that the two parts of the second connecting point 32, 42 are automatically aligned with one another when the handle 40 with its other handle end 47 has reached the afore described fastening position 19. This is determined first by rotational stops 38, 39. The rotational stops 38,39 are provided in the edge areas of the two stay portions 23, 24 of the second stay 22. A further peculiarity is to be considered in this connection.

The contact position of the two stay portions 23, 24 illustrated in FIG. 6 is moreover temporarily secured by a catch holder 60. This catch holder 60 comprises a catch projection 61 provided in the edge area of the two stay portions 23, 24 on the one stay portion 23 and an undercut catch depression 62 on the other stay portion 24. In the end phase of the rotational movement, illustrated in FIG. 6 also by the arrow 18, the catch projection 61 snaps into the catch depression 62 and thus secures the handle 40 temporarily in its desired fastening position 19. This is then finally secured by fastening means of the second connecting point 32, 42, which is achieved in the following way.

The two fastening means for the second connecting point 32, 42 are integrated into the two stay portions 23, 24 and, in the contact position of FIGS. 6, 7, and 8, they are automatically radially aligned relative to one another. They can, especially when the catch holder 60 is effective, immediately become connecting-active without having to align the handle 40 in any special way. These two parts of the second connecting point 32, 42 are comprised, on the side of the handle 40, of screw elements 42, i.e., in the present case of a threaded bolt 43 integrated into the corresponding stay portion 23 and of a nut 44 which can be threaded thereon. The other part of the second connecting point 32, 42 is comprised of a screw element receiver which is formed in this case as a slot 32 open at one end. During the aforementioned rotation 18 the flap is always in the folded-out position 30' illustrated in FIG. 9 so that the second stay portion 24 seated hereon can reach with the slot 32 the outer side 13 of the door. Subsequently, the bolt 43 is guided with the aid of the guiding action of the rotational axis 35 at the first connecting point 31, 41 reliably through the slot opening 33 into the slot 32. Then it is only required to tighten the nut 44 against the shoulder surface 54 illustrated in FIGS. 7 and 8. Now the handle 40 is secured in its final fastening position according to the dash-dotted line 19 of FIG. 1.

In the folding-out movement 15 of FIG. 9 already mentioned several times, the component comprised of the handle 40 and flap 30 moves together. It is transferred into the folded-out position 40', 30'.

A working arm 55 is fixedly connected to this component which is transferable from the rest position, illustrated by a dash-dotted line in FIG. 9, into the working position 55', illustrated in solid lines. On this working arm 55 a lock linkage which extends to a door lock, not shown, is connected which extends, for example, in the direction of arrow 56 of FIG. 9. The folding-out movement 15 thus also transfers the door lock from the rest position into a working position.

After completion of the fastening at the connecting point 32, 42 the component comprised of flap 30 and the handle 40 can then be returned into the folded-in position illustrated in a dash-dotted line in FIG. 9. For this purpose the aforementioned return spring 25 is provided. Now the end surfaces on the two handle ends 46, 47 shown in FIGS. 2 and 3 close off completely or partially the two openings 11, 12 in the outer sheet metal 10 of the door, wherein rubber seals or the like are being used for sealing relative to the door sheet metal 10. Usually, the second opening 12, as illustrated in FIG. 3, is greater in order to be able to receive in addition to the handle 40 other functional members 58, 59 which are illustrated in dashed lines in FIG. 3. Accordingly, in addition to the component of the handle 40 and the flap 30, there is a mounting array 53, shown in FIG. 1, for additional functional members 58, 59 which then cover the entire opening 12. These functional members include the closing cylinder component 58 which acts by key actuation also onto the door lock. This closing cylinder component 58 is seated in a styling cap 59 which extends the contour of the handle 40 positioned in the folded-in position. Both functional members 58, 59 are mounted from the inner side 14 of the door on the outer sheet metal 10 of the door and close then also the remainder of the second opening 12. Especially, these functional members 58, 59 cover the access to the second connecting point 32, 42. In the folded-in position of the component 30 of FIG. 9 this connecting point is actually located on the inner side 14 of the door. Accordingly, unauthorized persons can therefore not easily demount the handle 40 from the outer side 13 of the door. However, this is possible for an authorized person which has access by a key to the inner side 14 of the door.

Figure 10:
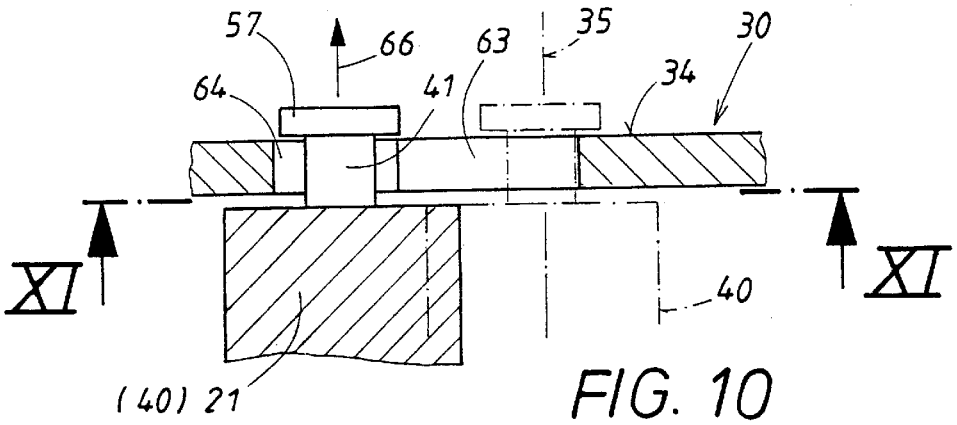
FIG. 10 an alternative embodiment of the adjusting connection at the first connecting point in horizontal section in a sectional representation corresponding to that of FIG. 5.
Figure 11:
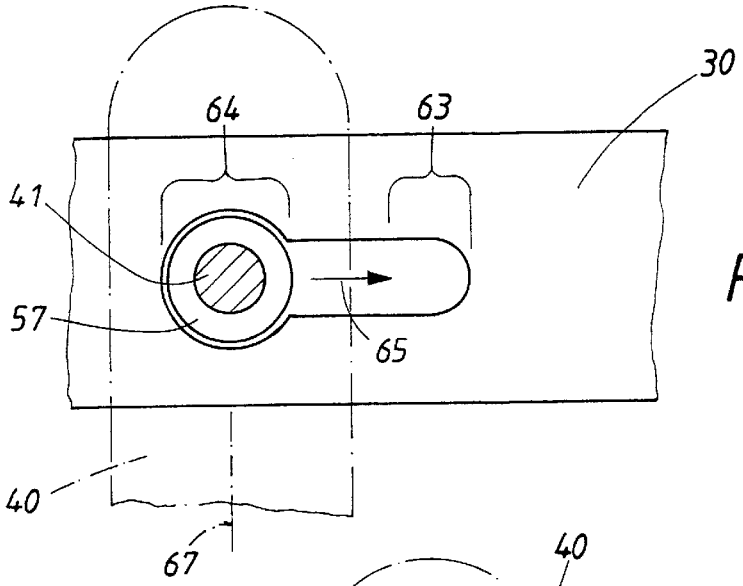
FIG. 11 a sectional plan view onto the second adjusting connection shown in FIG. 10 along the section line IX—IX of FIG. 10, after completion of the first movement phase.
Figure 12:
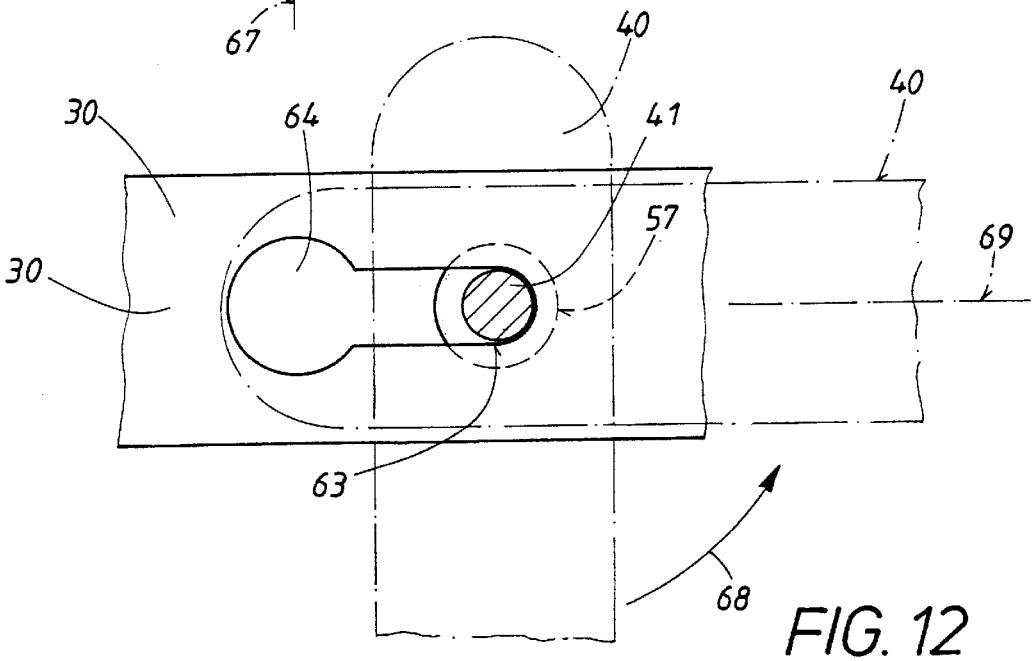
FIG. 12 in plan view corresponding to that of FIG. 11 the adjusting connection at the first connecting point after completion of the second movement phase.

In FIGS. 10 through 12 a first alternative embodiment of the components at the first connecting point is illustrated in a schematic manner. For referencing same components the same reference numerals as in the first embodiment of FIGS. 1 through 9 are used so that in this connection the aforementioned description is applicable. It is sufficient to point out only the differences.

These reside in that the pivot pin 41 has a projection in the form of a pin head 57 of radial symmetry, radially projecting on all sides, on the first stay 21 belonging to the handle 40. An opening 63, 64 with a key hole-like opening profile is correlated with this pivot pin 41. It is comprised of a narrow opening area 63 and a wide opening area 64. The wide opening area 64 is greater than the profile of the pin head 57. Accordingly, the aforementioned insertion movement in the direction of arrow 66 of FIG. 10 can be carried out without problems. Accordingly, the pin head 57 with its shoulder surface facing the pivot pin 41 will reach an inner shoulder 34 provided on the flap 30 which shoulder extends transverse to the direction of the insertion movement 66. This insertion position is illustrated in FIGS. 10 and 11. In the present case, guiding means can ensure a defined angular position of the handle 40 for the insertion movement, for example, so that the handle 40, for example, is positioned in the angular position illustrated in FIG. 11 by the dashed-dotted line 67. Such guide means can be arranged between the handle, on the one hand, and the support or the flap 30, on the other hand. As an alternative, it is also possible to provide for this purpose outer contours on the opening profile 64 and the pin head 57.

After the insertion movement of FIGS. 10 and 11 a displacement phase of the component 40 in the direction of arrow 65 of FIG. 11 follows. Accordingly, the pivot pin 41 reaches the aforementioned narrow opening area 63 of the opening profile, as is illustrated in FIG. 12. This narrow opening area 63 forms then the pivot seat for the rotational movement following thereafter and illustrated by the arrow 68 in FIG. 12. This movement guides the handle 40 again into the fastening position 69 on the flap 30 illustrated by the auxiliary line 69 in FIG. 12 where the slot 32 and the screw element 42 of the second connecting point mentioned in connection with the previous embodiment will become effective. Upon rotation 68 the rotational axis 35 between the handle 40 and the flap 30 is again active which axis is illustrated in FIG. 10.

While in the first embodiment of FIGS. 1 through 9 the first connecting point 31, 41 represents a rotational adjusting connection, in the second embodiment of FIGS. 10 through 12 one could speak of a displacement adjusting connection at the connecting point of the pivot pin 41 and the narrow opening area 63, based on the second movement phase characterized by the displacement movement 65.

Figure 13:
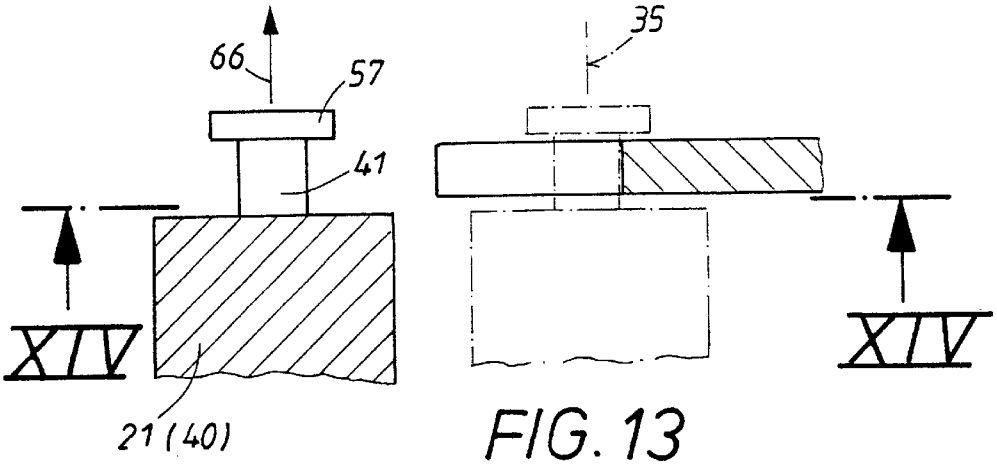
FIG. 13 in a sectional view corresponding to that of FIG. 10 a third embodiment of the first connecting point.
Figure 14:
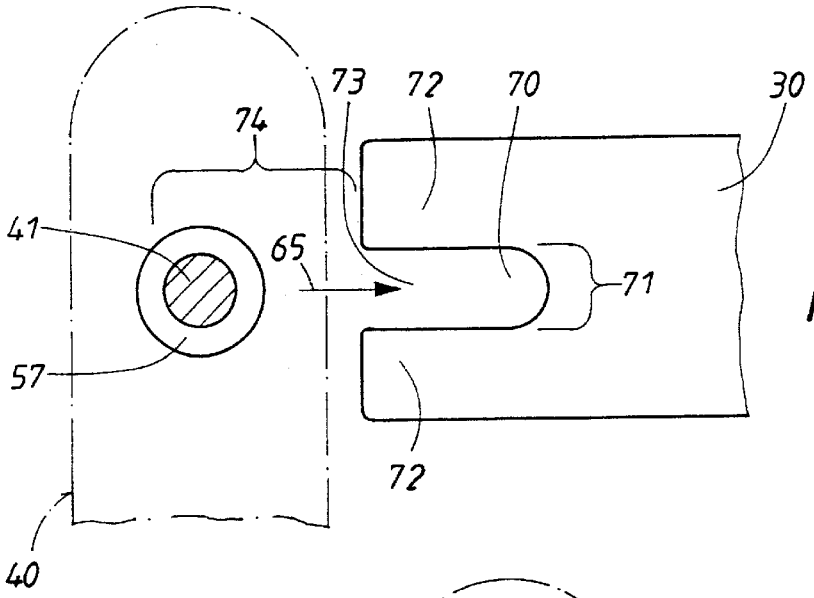
FIG. 14 in analogy to FIG. 11, a sectional plan view onto the two components of the third embodiment illustrated in FIG. 13 of the connecting point along the section line XIV—XIV of FIG. 13.
Figure 15:
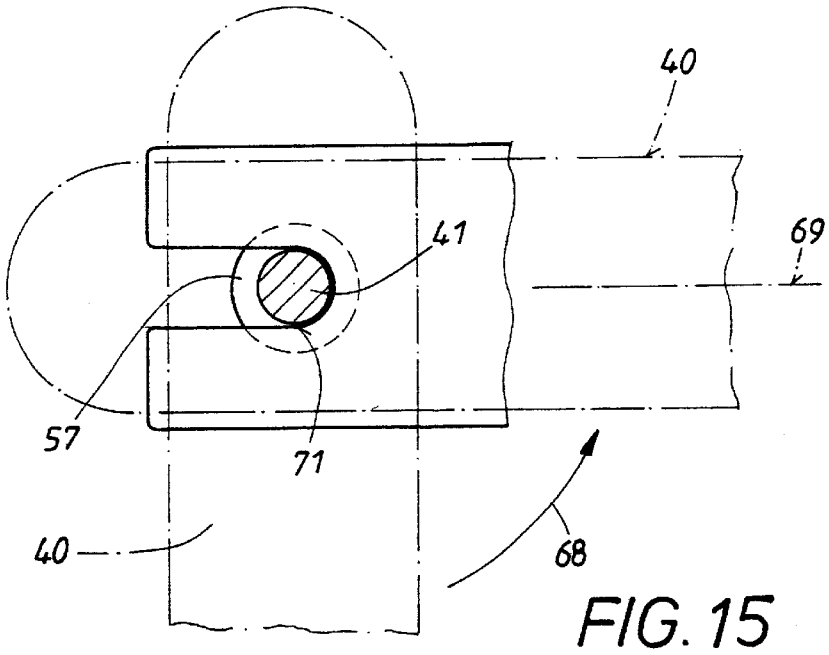
FIG. 15 in analogy to FIG. 12 the connection of the components of FIG. 13 after the second movement phase.

A third variant of the invention is illustrated in FIGS. 13 through 15 which can be derived from the adjusting connection of the second embodiment of FIGS. 10 through 12. The FIGS. 13 through 15 describe the analog conditions which have been previously explained in connection with the second embodiment of FIGS. 10 through 12. In order to avoid repetition, reference is being had to the preceding embodiments. It is sufficient to only describe the differences of this third embodiment relative to the preceding ones.

This third embodiment results when the component of the first embodiment according to FIGS. 10 through 12 belonging to the flap 30 is cut away so that then the wide opening area 64 is eliminated in the third embodiment. The flap 30 comprises a fork 70 formed between two fork legs 72. The free space 74 positioned before the fork opening 73 provides an passage in order to perform here the aforementioned insertion movement 66 of the pivot pin 41. This is illustrated in FIGS. 13 and 14. Subsequently, a displacement movement 65 is again performed so that the pin head 57 will move into the fork opening 70 and reach the fork bottom 71. The fork bottom 71 provides the pivot seat for the pivot pin 41 according to FIG. 15. Here the pivot axis 35 illustrated in FIG. 13 is again formed for the rotational movement 68 illustrated in FIG. 5 into the final fastening position 69 of the handle 40.

List of Reference Numerals

10 door sheet metal
11 first opening
12 second opening
13 outer side of door
14 inner side of door
15 part of the folding-out movement (FIG. 9)
16 arrow of the insertion movement of 41 into 31
16' pulling-out movement of 41 from 31 (FIG. 5)
17 auxiliary line for angular position of 40 (FIG. 1)
18 arrow of the rotational movement of 40 (FIGS. 1, 4)
19 auxiliary line of the final fastening position of 40 (FIG. 1
20 support
21 first stay on 40
22 second stay
23 first portion of 22 on 40
24 second portion of 22 on 30
25 torsion spring, return spring for 40
26 bearing axle of 20 for 30
27 bearing location
28 first connecting point of 20 on 10
29 second connecting point of 20 on 10
30 flap (folded-in position)
30' folded-out position of 30
31 part of first connecting point, pivot seat
32 part of second connecting point, screw receiver, slot
33 slot opening of 32
34 inner shoulder on 30 (FIG. 5)
35 rotational axis of 31, 41 (FIG. 5)
36 auxiliary line of the door plane (FIG. 3)
37 counter bearing location for 26
38 first rotational stop on 30 at 24
39 second rotational stop on 40 at 23
40 handle (folded-in position)
40' folded-out position of 40
41 portion of first connecting point, pivot pin
42 portion of the second connecting point, screw element
43 threaded bolt of 42
44 nut of 42 on 43
45 concave arc side of 40
46 first handle end of 40
47 second handle end of 40
48 central arc portion of 40
49 collar on 21, collar segment (FIG. 5)
50 adjusting connection between 31, 41
51 first closure half of 40, radial projection
51' locked position of 51 (FIGS. 4, 5)
52 other closing half of 50, radially widened portion of 31, opening for 51
53 mounting array (FIG. 1)
54 shoulder surface on 24 for 44 (FIG. 7)
55 working arm on 30 (rest position)
55' working position of 55 (FIG. 9)
56 arrow of the lock linkage
57 pin head (FIGS. 10, 13)
58 functional member, closing cylinder component
59 functional member, styling cap
60 catch holder between 23, 24 (FIG. 6)
61 catch projection of 30
62 catch depression of 30
63 profiled opening narrow opening area (FIG. 11)
64 profiled opening (wide opening area)
65 arrow of sliding movement of 41 (FIG. 11)
66 arrow of insertion movement of 41 (FIG. 10)
67 auxiliary line of angular position of 40 (FIG. 11)
68 arrow of the rotational movement of 40 (FIG. 12)
69 auxiliary line of the final fastening position of 40
70 fork opening (FIG. 14)
71 fork bottom of 70, pivot seat for 41

72 fork legs of 70
73 fork opening of 70
74 free space before 73

What is claimed is:

1. An actuating device for a vehicle door lock, comprising:

a hinged handle arranged on an outer side of a vehicle door and having two ends;

a support connectable at an inner side of the vehicle door behind an outer sheet metal of the vehicle door, wherein the support comprises a bearing axle extending substantially parallel to a door plane of the vehicle door;

a flap pivotally supported on the bearing axle, wherein the flap has two connecting points for the two ends of the handle positioned at the outer side of the vehicle door, wherein the flap and the handle connected thereto form a single component so as to pivot together;

wherein the flap has stays in the area of the two connecting points and the stays penetrate an opening in the outer sheet metal of the vehicle door;

wherein a first one of the connecting points is provided on the first stay and is comprised of a rotary bearing having a pivot pin and a pivot seat;

wherein the pivot pin and the pivot seat define a pivot axis extending substantially perpendicularly to the door plane, wherein the pivot axis defines an insertion direction of an insertion movement of the pivot pin into the pivot seat;

wherein, during the insertion movement of the pivot pin into the pivot seat, the handle is positioned in an angular position at an angle of rotation relative to a final fastening position of the handle on the flap;

wherein the free end of the pivot pin has at least one radial projection and the pivot seat has an opening correlated with the at least one radial projection, wherein the opening is a passage for the at least one radial projection during insertion movement of the pivot pin into the pivot seat;

wherein the pivot seat, viewed in the insertion direction, has behind the opening an inner shoulder extending transversely to the insertion direction;

wherein the inner shoulder is engaged from behind by the at least one radial projection of the pivot pin and secures the pivot pin and the pivot seat axially non-detachably;

wherein a second one of the connecting points is provided on the second stay and is comprised of a first part provided on the handle and a second part provided on the flap;

wherein the handle is rotated back about a return angle from the angular position on the outer side of the vehicle door in the rotary bearing to such an extent that the first and second parts of the second connecting point are in a radially aligned position with one another;

and wherein the first and second parts of the second connecting point are connected to one another in the radially aligned position and determine the final fastening position of the handle on the flap.

2. The actuating device according to claim 1, further comprising a fork having two fork legs and a fork bottom connecting the fork legs, wherein opposite the fork bottom a fork opening is defined between the two fork legs and wherein the fork bottom provides the pivot seat, wherein a free space before the fork opening serves as a passage for the at least one radial projection during insertion of the pivot pin into the pivot seat until the at least one radial projection reaches a point axially behind the fork opening, wherein the handle positioned on the outer side of the vehicle door carries out a displacement movement until the pivot pin is inserted into the fork and until the at least one radial projection engages behind at least one of the two fork legs, wherein the at least one of the two fork legs then forms the inner shoulder of the pivot seat.

3. The actuating device according to claim 2, wherein the fork extends substantially parallel to the door plane and the fork opening is facing away from the second connecting point, wherein the pivot pin during the displacement movement is moved in the fork toward the second connecting-point.

4. The actuating device according to claim 1, wherein the at least one radial projection and the opening correlated with the at least one radial projection form two complementary closing halves of an adjusting connection, wherein an adjusting movement of the two closing halves has a-movement sequence comprised of a first movement phase and a second movement phase, wherein the first movement phase is the insertion movement of the pivot pin and the pivot seat.

5. The actuating device according to claim 4, comprising a key hole opening with a narrow opening area and a wide opening area, wherein the narrow opening area forms the pivot seat while the wide opening area is the passage for the at least one radial projection of the pivot pin, wherein the second movement phase is a displacement of the pin from the wide opening area into the narrow opening area.

6. The actuating device according to claim 5, wherein the displacement is linear and wherein the narrow opening area is closer to the second connecting point than the wide opening area.

7. The actuating device according to claim 6, comprising guide means for defining the final fastening position, wherein, during the insertion movement of the pivot pin, during the displacement of the pivot pin in the opening, or during insertion movement and displacement of the pivot pin, the handle is in the angular position relative to the final fastening position on the vehicle door, wherein the guide means release the handle for rotation only after completion of the adjusting movement.

8. The actuating device according to claim 7, wherein the guide means are arranged between the handle and the support or between the handle and the flap.

9. The actuating device according to claim 7, wherein the guide means are comprised of outer contours of the key hole opening and the pivot pin or the key hole opening and the at least one radial projection of the pivot pin.

10. The actuating device according to claim 1, wherein the at least one radial projection on the pivot pin is a pin head provided at an end of the pivot pin of and widened relative to the pivot pin.

11. The actuating device according to claim 10, wherein the pin head substantially has radial symmetry relative to the axis of the pivot pin.

12. The actuating device according to claim 4, wherein the passage for the at least one projection is comprised of a radially widened portion of the pivot seat and wherein the radially widened portion matches the outer contour of the at least one radial projection, wherein, in the final fastening position of the handle, the contour profile of the at least one radial projection carries out a rotation relative to the radially widened portion about the return angle of the handle for the radial alignment of the first and second parts of the second connecting point, wherein the rotation at the same time is the second movement phase of the adjusting movement.

13. The actuating device according to claim 1, wherein at least one portion of the stay of the first connecting point is a fixed component of the handle and forms a continuous handle/stay combination with the handle.

14. The actuating device according to claim 13, wherein the stay supports the pivot pin on a free end of the stay, wherein the stay, for mounting the handle on the flap, is insertable from the outer side of the vehicle door through the opening in the outer sheet metal of the vehicle door to the inner side of the vehicle door.

15. The actuating device according to claim 1, wherein at least one portion of the stay of the second connecting point is a fixed component of the flap and forms an asymmetric flap component, wherein, after attachment of the support on the inner side of the door, the at least one stay portion of the asymmetric flap component, at least in a folded-out position, reaches with the first part of the second connecting point provided thereon to the outer side of the door.

16. The actuating device according to claim 15, wherein in a folded-in position of the hinged handle, defining a rest position of the hinged handle, the second connecting point reaches the inner side of the vehicle door.

17. The actuating device according to claim 16, wherein the support, adjacent to a location where the second connecting point is accessible in the folded-out position from the outer side of the vehicle door, has a mounting array for at least one further functional member, wherein the attachment of the at least one functional member is carried out from the inner side of the vehicle door, and wherein the functional members, after attachment, make the second connecting point inaccessible from the outer side of the vehicle door.

18. The actuating device according to claim 17, wherein the functional member is comprised of a blind styling cap for non-lockable versions of the vehicle door lock.

19. The actuating device according to claim 1, wherein the second stay is comprised of a first portion seated on the handle and a second portion seated on the flap, wherein the first and second parts of the second connecting point are complementary to one another and are integrated in ends of the first and second portions.

20. The actuating device according to claim 19, wherein the first portion of the second stay has a screw element and the second portion of the second stay has a screw element receiver configured to receive the screw element.

21. The actuating device according to claim 20, wherein the screw element is comprised of a stationary threaded bolt and a nut threadable thereon, wherein the screw element receiver is comprised of a slot having an opening at one end, wherein the opening of the slot is oriented in a direction of rotation of the handle.

22. The actuating device according to claim 19, wherein the first and second portions of the second stay have rotational stops delimiting a rotation of the handle between the angular position during insertion and the final fastening position.

23. The actuating device according to claim 19, wherein the first portion of the second stay has a catch projection and the second portion of the stay has a catch depression, wherein the catch depression and the catch projection together form a catch holder, wherein in the final fastening position of the handle, the catch projection and the catch depression are radially aligned with one another and snap into one another to provide a temporary fastening action of the handle on the flap.

24. The actuating device according to claim 23, wherein the hinged handle has a central arc portion with a concave arc side, facing the outer sheet metal of the vehicle door and providing a passage for a hand, and wherein the central arc portion is configured to be gripped all around by a hand like a pull handle.

* * * * *